US006021581A

United States Patent [19]

Graf

[11] Patent Number: 6,021,581

[45] Date of Patent: Feb. 8, 2000

[54] METHOD OF DRYING A PAPER WEB IN A PAPER-MAKING MACHINE AT SPEEDS GREATER THAN 6000 FEET PER MINUTE

[75] Inventor: Edwin X. Graf, Menasha, Wis.

[73] Assignee: Voith Sulzer Paper Technology North America, Inc., Appleton, Wis.

[21] Appl. No.: 09/102,029

[22] Filed: Jun. 22, 1998

[51] Int. Cl.[7] ..... F26B 3/00

[52] U.S. Cl. ..... 34/447; 34/454; 34/482; 34/499

[58] Field of Search ..... 34/443, 444, 445, 34/447, 454, 482, 499, 110, 117, 611; 162/336, 344; 148/579, 581, 590; 420/4, 8, 10, 13, 19, 22

[56] References Cited

U.S. PATENT DOCUMENTS

| | | | |
|---|---|---|---|
| 3,241,249 | 3/1966 | Lavender | 34/447 |
| 4,542,593 | 9/1985 | Viitanen et al. | 34/454 |
| 4,688,335 | 8/1987 | Krill et al. | 34/454 X |
| 5,249,621 | 10/1993 | Aghajanian et al. | 164/97 |
| 5,280,819 | 1/1994 | Newkirk et al. | 164/98 |
| 5,653,331 | 8/1997 | Graf | 198/807 |
| 5,853,546 | 12/1998 | Graf | 162/344 |
| 5,933,980 | 8/1999 | Deshpande et al. | 34/454 X |

*Primary Examiner*—Henry Bennett
*Assistant Examiner*—Steve Gravini
*Attorney, Agent, or Firm*—Taylor & Associates, P.C.

[57] ABSTRACT

A method of drying a fiber web in a paper-making machine includes the step of providing a heated dryer roll which carries the fiber web. The dryer roll has a shell consisting essentially of compacted graphite cast iron. The dryer roll is rotated such that the dryer roll has a peripheral speed which is greater than approximately 6000 feet per minute.

7 Claims, 1 Drawing Sheet

METHOD OF DRYING A PAPER WEB IN A PAPER-MAKING MACHINE AT SPEEDS GREATER THAN 6000 FEET PER MINUTE

BACKGROUND OF THE INVENTION

1. Field of the invention.

The present invention relates to paper-making machines, and, more particularly, to a method of drying a paper web with a dryer roll in a paper-making machine.

2. Description of the related art.

A paper making machine includes a wet end and a dry end, with the dry end including a dryer section with a plurality of dryer units. Each dryer unit includes a plurality of dryer cylinders which are heated by a hot fluid which is transported therethrough. The heat is transferred through the shell of the dryer roll to the paper web contacted thereby to heat and dry the paper web. Typically, the dryer rolls are formed from cast iron. White cast iron is relatively brittle, hard and has a poor thermal conductivity. Accordingly, dryer rolls are usually made from grey cast iron which has a better thermal conductivity.

With time, the traveling speed of a paper web within a paper making machine has increased. Paper webs can now be transported through a paper making machine at a maximum traveling speed of approximately 5000 feet per minute. It is estimated that in years to come, the traveling speed of a paper making machine may be greater than 6000 feet per minute, and possibly even greater than 7000 feet per minute.

A problem which will have to be overcome as the paper web travel speeds exceed 6000 feet per minute are the physical limitations of the material from which the rolls in the dryer section are formed. At peripheral speeds greater than 6000 feet per minute, the grey cast iron from which conventional dryer rolls are formed has insufficient hoop strength and flies apart because of the centrifugal forces imparted thereon during use. Thus, although a grey cast iron dryer roll has good thermal conductivity properties and may be used at relatively slower speeds, a dryer roll formed from grey cast iron cannot be used at traveling speeds greater than 6000 feet per minute.

What is needed in the art is a dryer roll which has good thermal conductivity properties and which may be used at traveling speeds greater than 6000 feet per minute.

SUMMARY OF THE INVENTION

The present invention provides a dryer roll which has good thermal conductivity and is capable of rotating at peripheral speeds greater than 6000 feet per minute.

The invention comprises, in one form thereof, a method of drying a fiber web in a paper-making machine. A heated dryer roll which carries the fiber web has a shell consisting essentially of compacted graphite cast iron. The dryer roll is rotated such that the dryer roll has a peripheral speed which is greater than approximately 6000 feet per minute.

An advantage of the present invention is that the dryer roll can be rotated with a peripheral speed greater than 6000 feet per minute.

Another advantage is that the dryer roll has good thermal conductivity.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
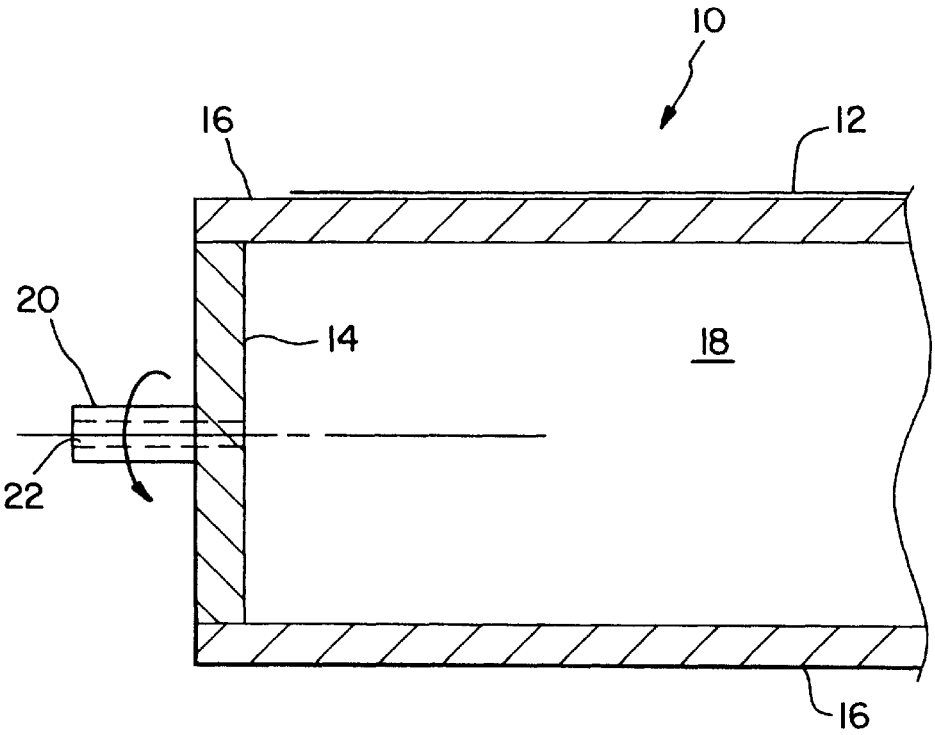
FIG. 1 is a side, sectional view of an embodiment of a dryer roll of the present invention, with which the method of drying a paper web of the present invention may be carried out.
Figure 2:
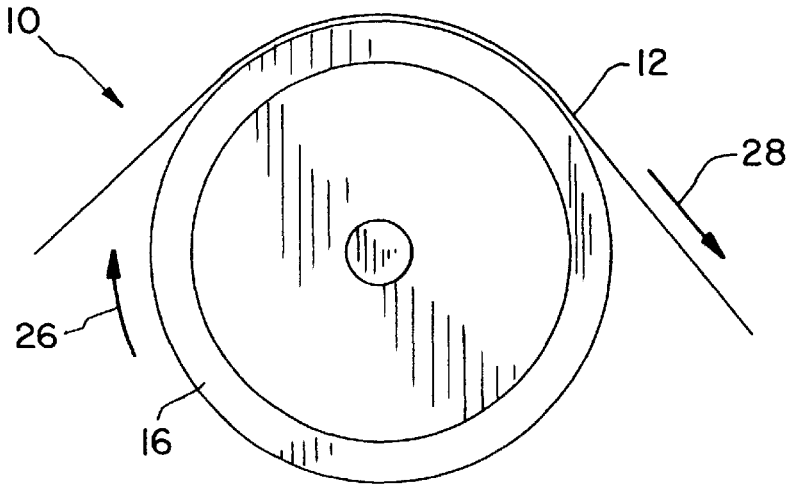
FIG. 2 is an end view of the dryer roll of FIG. 1.

Referring now to the drawings, there is shown an embodiment of a dryer roll 10 which is incorporated into a paper-making machine which produces a fiber web which is in the form of a paper web 12 in the embodiment shown. The fiber web may also be in the form of, e.g., board or tissue.

Dryer roll 10 includes a head 14 at each axial end thereof which is surrounded and supported by a shell 16. Head 14 includes a hollow inner cavity 18 in which may be disposed suitable fluid piping and passages (not shown for clarity) for transporting a hot fluid through and thereby heating dryer roll 10. Each head 14 is attached to a respective axle journal 20. Each head 14 and attached axle journal 20 include a bore 22 which is in fluid communication with the fluid piping and/or passages within inner cavity 18 and allow the heated fluid to be transported to and from dryer roll 10.

Each head 14 is formed from ductile iron which consists essentially of an alloy of iron, carbon and magnesium. The magnesium causes the carbon within the iron to form into small nodules which increases the tensile strength of the iron.

Shell 16 surrounds heads 14 and is metallurgically attached to heads 14 such as through a weld. Shell 16 consists essentially of an alloy of iron, carbon and cerium, with the carbon preferably being in the form of graphite. The cerium causes the graphite within the iron to form into small nodules which improves the tensile strength and hoop strength of shell 16. The compacted graphite cast iron has a hoop strength which is sufficient to allow dryer roll 10 to be rotated with a rotational speed resulting in a peripheral speed (indicated by arrow 26) which is greater than 6000 feet per minute, corresponding to a traveling speed (indicated by arrow 28) of paper web 12 greater than 6000 feet per minute. The peripheral speed and corresponding traveling speed may also exceed 6000 feet per minute. Shell 16 preferably consists essentially of between approximately 89 and 96 percent iron; up to approximately 4 percent carbon; up to approximately 2.5 percent silicon; between approximately 0.25 and 1.5 percent manganese; up to approximately 2 percent copper; and less than approximately 1 percent cerium by weight.

In the embodiment shown, each head 14 is formed from an alloy of iron, carbon and magnesium, and shell 16 is formed from an alloy of iron, carbon and cerium. This combination is sufficient to withstand the centrifugal forces which are imparted upon dryer roll 10 at traveling speeds of greater than 6000 feet per minute. Additionally, the alloy of iron, carbon and magnesium from which each head 14 is formed is less thermally conductive than the compacted graphite cast iron from which shell 16 is formed. This may be of particular note for specific applications where it is desirable to transfer a minimum of heat to the bearing assemblies and framework carrying axle journal 20 of each head 14. Of course, it will be appreciated that dependent upon the specific application, cost constraints, etc., it may be possible to form each of heads 14 and shell 16 from compacted carbon cast iron consisting essentially of an alloy of iron, carbon and cerium.

If a conventional dryer roll formed from grey cast iron or white cast iron was rotated with a peripheral speed of greater than 6000 feet per minute, the dryer roll would fly apart since the hoop strength of white cast iron or grey cast iron is not capable of withstanding such centrifugal forces. A ductile iron formed from an alloy of iron, carbon and magnesium may have sufficient hoop strength to withstand the centrifugal forces at such high peripheral speeds, but does not have sufficient thermal conductivity to allow paper web 12 to be adequately heated and dried. The compacted carbon cast iron which is used in the dryer roll 10 of the present invention has a hoop strength which is sufficient to withstand such high centrifugal loading at high speeds, and still has good thermal conductivity to transfer heat from the hot fluid within inner cavity 18 to the paper web 12 to thereby dry paper web 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of drying a fiber web in a paper-making machine, comprising the steps of:

providing a heated dryer roll carrying the fiber web, said dryer roll having a shell consisting essentially of compacted carbon cast iron; and rotating said dryer roll such that said dryer roll has a peripheral speed which is greater than approximately 6000 feet per minute.

2. The method of claim 1, wherein said compacted carbon cast iron consists essentially of an alloy of iron, carbon and cerium.

3. The method of claim 2, wherein said carbon consists essentially of graphite.

4. The method of claim 2, wherein said providing step comprises the sub-step of casting said dryer roll shell.

5. The method of claim 2, wherein said fiber web carried by said dryer roll comprises one of paper, board and tissue.

6. The method of claim 1, wherein said dryer roll includes at least one head surrounded by said shell, each said head comprised of ductile iron which consists essentially of an alloy of iron, carbon and magnesium.

7. The method of claim 1, wherein said rotating step compries rotating said dryer roll such that said dryer roll has a peripheral speed which is greater than approximately 7000 feet per minute.

* * * * *